US010222074B2

(12) United States Patent
Marino et al.

(10) Patent No.: US 10,222,074 B2
(45) Date of Patent: Mar. 5, 2019

(54) PLASTIC BASEBOARD HEATER DEVICE

(71) Applicant: PLASTX USA CORP., Oceanside, NY (US)

(72) Inventors: Angelo Marino, Oceanside, NY (US); Gregory Meller, Oceanside, NY (US)

(73) Assignee: Amarino LLC, Oceanside, NY (US)

( * ) Notice: Subject to any disclaimer, the term of this patent is extended or adjusted under 35 U.S.C. 154(b) by 0 days.

(21) Appl. No.: 14/529,889

(22) Filed: Oct. 31, 2014

(65) Prior Publication Data

US 2016/0273785 A1 Sep. 22, 2016

Related U.S. Application Data

(60) Provisional application No. 61/898,318, filed on Oct. 31, 2013.

(51) Int. Cl.
*F24D 19/06* (2006.01)

(52) U.S. Cl.
CPC ..... *F24D 19/06* (2013.01); *F24D 2220/2072* (2013.01)

(58) Field of Classification Search
CPC ..... F24D 19/06; F24D 2220/2072
USPC ..... 165/53, 55, 56, 72, 73, 75, 135; 392/352; 219/523, 530
See application file for complete search history.

(56) References Cited

U.S. PATENT DOCUMENTS 3,448,795 A * 6/1969 McNabney ..... F24D 19/04 165/55
4,305,430 A * 12/1981 Svensson ..... E04H 3/08 138/111
6,632,047 B2 * 10/2003 Vinegar ..... B09C 1/062 405/128.15
6,834,710 B2 * 12/2004 Weintraub ..... F24D 19/04 165/55
6,889,911 B2 * 5/2005 Uglietto ..... F24D 19/06 165/55
8,347,950 B2 * 1/2013 Stroobants ..... F24D 19/0082 165/181

* cited by examiner

*Primary Examiner* — Keith Raymond
*Assistant Examiner* — Nael Babaa
(74) *Attorney, Agent, or Firm* — Pryor Cashman LLP

(57) ABSTRACT

The present invention relates to a plastic cover, preferably made of CPVC plastic, for traditional baseboard heaters. The plastic cover contains a front piece with bulges and a connected perforated top piece with back flanges. The plastic cover is supported by preferably two support brackets which are attached to the wall. The support brackets have top and bottom slots in the back and protruding arms which fit into the bulges of the front piece. The slots of the support brackets hold top and bottom angled slats that direct hot air into a room. The plastic cover is easily attached to the support brackets as the bulges snap into place over the protruding arms of the support bracket and the back flanges of the top cover piece locks onto the top slat held in place by the supporting brackets. Side pieces prevent hot air from escaping and might further include straight or corner connectors to longitudinally extend the plastic cover.

12 Claims, 10 Drawing Sheets

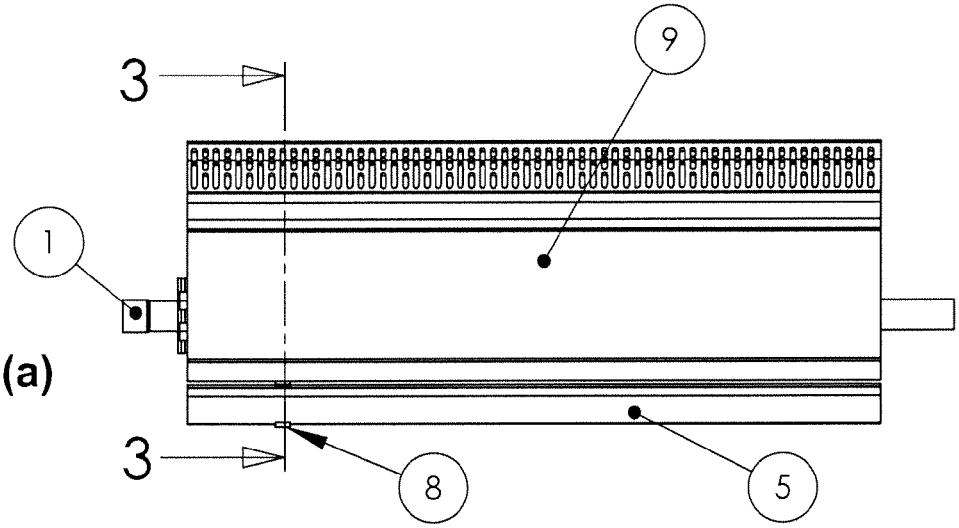
FIG 3(a)
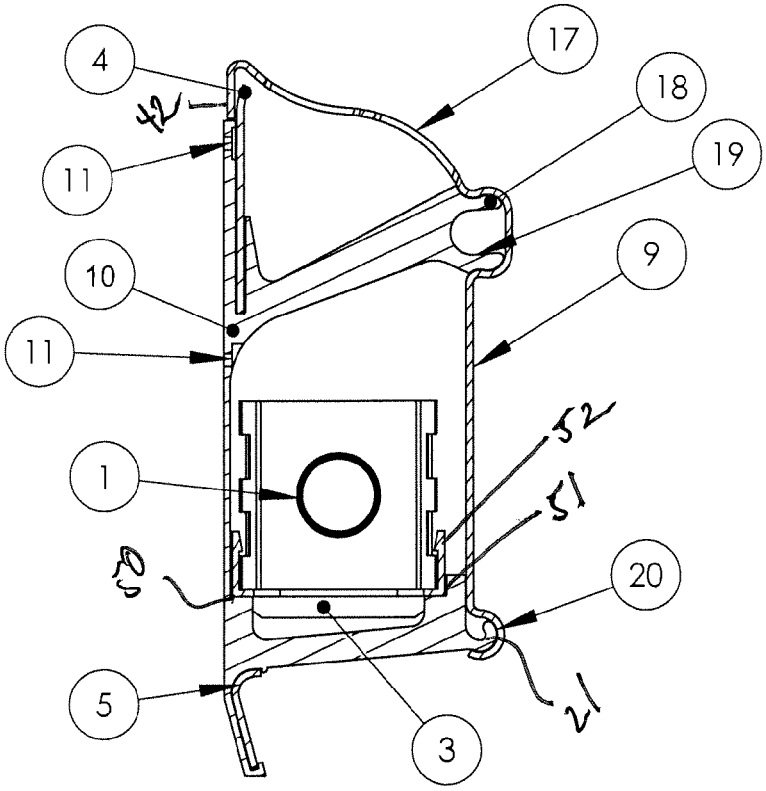
FIG 3 (b)

PLASTIC BASEBOARD HEATER DEVICE

FIELD OF THE INVENTION

The present invention relates to a plastic cover for traditional baseboard heaters that is supported on brackets which are themselves secured to a wall. The plastic is preferably CPVC plastic. The invention replaces the traditional metal covers and thereby reduces noise, eliminates rust, is lightweight, easy to manufacture, and prevents other problems associated with the metal baseboard heater covers now in use. The invention is easily installed on traditional and in-use baseboard heaters and simply replaces the metal cover—not the radiator fins. The plastic cover of the invention consists of a front, flat piece that is integrated or connected to a top cover section. Preferably, the front piece and the top cover are made of one continuous piece of plastic where the front covers turns rearwardly from the front of the baseboard heater to be on top of and thus cover the top of the baseboard heater and eventually abut and be secured to the vertical wall surface to which the baseboard heater elements are secured. The front piece has two top and bottom bulges for easily connecting the front piece to the support brackets. The top of the cover has small holes punched therethrough for hot air radiation/escape. The invention also comprises preferably two support brackets, which preferably have apertures that enable one to attach the brackets to a wall using screws or nails. The support brackets are extending arms that each have two slots towards the back, one top and one bottom, and protruding arms extending forwardly. The slots hold top and bottom plastic or metal, horizontally extending, slats that direct warm air inwardly, away from the vertical wall to which the baseboard heater is secured and into the center of a room. The protruding arms provide a connection for the plastic cover as the bulges of the plastic cover mate with the protruding arms and therefore snap into place. To further secure the invention, the top piece of the plastic cover has a flange in the rear which locks onto the top slat of the baseboard heater members. The bottom bulge might also include a hook for a more secure fit with the bottom bulge. The invention further includes side or end pieces that are distanced from the front plastic cover so that the front plastic cover may expand and contract with changes in the delivery of heat and, in addition, so that heat does not escape out of the sides of the heater but, rather, is directed into the interior or center of the room for uniform heating and heating efficiency. The end or side pieces provide no structural support, however. Further, the invention can include longitudinal connector pieces which connect multiple aligned plastic covers for longer heaters, and interior and exterior corner pieces for heaters that fit in and around the corners of a room.

BACKGROUND OF THE INVENTION AND DISCLOSURE

The present invention relates to a cover supported on a bracket held to a wall for protecting a conventional baseboard heater system in residential or commercial use. Specifically, the invention comprises an inventive bracket and snap-on cover for a baseboard heater. Baseboard heaters are conventionally made of horizontally extending copper pipes (with hot water coursing therethrough when "heat" is demanded by the system's thermostat) and a set of tightly spaced, thin aluminum, longitudinally extending plates or fins with central apertures which pass over the copper piping. The surface area of the fins radiates the heat to the room sought to be heated, with the heat radiating through the longitudinal apertures of the protective cover for the fins and pipes. The covers, conventionally, are made of simple sheet metal, often thin steel, and, when contacted by water or other liquid urine, causes rust to appear and, in any event, when the metallic fins come into contact with the cover and one another, often result in cracking noises which can be annoying. The present invention comprises a bracket securable to the vertical wall of the room sought to be heated, located, behind the copper piping and the fins and comprises a snap on, preferably plastic cover. The invention will eliminate rusting of a baseboard heater's cover (as it is replaced by a non-rusting material) and, in addition, will tend to reduce the noise due to relative differences in coefficient of expansion and contraction among the components. The bracket will hold the snap on cover in position and, yet, allows for selective access to the copper piping and fins, as needed. The brackets and non-metallic cover will protect the copper piping and the horizontally extending longitudinal fins, providing a tight yet with clearance fit therebetween which will allow for proper heat radiation and, yet, with a minimum of profile/space being occupied. The plastic cover eliminates rusting, is lightweight, easy to manufacture, will not present sharp metallic edges on the ends and is able to be inexpensively molded in comparison to sheet metal covers for baseboard heater elements in residential homes.

Preferably, the cover is made from a heat-resistant and water resistance plastic, preferably CPVC, as opposed to thin-walled steel to eliminate or reduce the opportunity for relative expansion and contraction (and accompanying noise associated therewith) of the materials during change of temperature conditions (i.e., when highly heated water courses through the copper pipes, radiates from the surface area of the aluminum fins, and then emanates to the room through openings in the cover) and the cessation of the same, when the room's thermostat shuts off the coursing of the flow of heated water.

The present inventive baseboard heater cover is adapted to be easily removable and replaceable. The plastic material helps to reduce or maintain the noise level caused by the pipes and heating system during operation of the heater. The present invention also is advantageous in that it does not rust as metal would, does not dent, as the material is more resilient than metal, and is more aesthetically pleasing than a conventional metal heating cover. It is simple and inexpensive to manufacture and is lightweight.

The present inventive heater cover is preferably provided in a variety of colors (by coloring of the plastic rather than the expense and time of painting the sheet metal of conventional baseboard heaters) and can be presented in a variety of aesthetic designs. Because it is easily removable, a user can easily remove the same from a heater and replace it with a different cover of a desired color. The ease of removal is also advantageous for cleaning, as it helps ensure that dust does not accumulate in crevices which are not visible while the present inventive cover is attached to a baseboard heater. Finally, the present invention is designed to quickly and easily snap into place onto other corresponding parts so that the same holds firmly in place and conceals the heater beneath.

The present invention is designed to meet the guidelines or standards published by the International Organization for Standardization ("ISO"), namely ISO-9001, which deals with the requirements for these types of products and materials. While the ISO does not set the standard, it provides guidelines for quality heat transfer and management systems. Third party certification bodies provide independent confirmation that organizations meet the requirements of ISO 9001. Here, the present invention is designed to meet standards set by the International Plumbing Code, Chapter 5, relating to Water Heaters, and Chapter 6 relating to Water Supply and Distribution, as well as the applicable standards of the International Mechanical Code, Chapter 10, relating to Boilers, Water Heaters, and Pressure Valves, the teachings of all of which are expressly incorporated herein by reference. Those regulations can be found at the International Code Council website for the International Plumbing Code and Mechanical Code, http://publicecodes.cyberregs.com/icod/pic/2012/index.htm and http://publicecodes.cyberregs.com/icod/imc/2012/index.htm, respectively.

DESCRIPTION OF THE PRIOR ART

Conventional residential and commercial baseboard heaters for rooms/office space/stores, etc. employ horizontal, hot water carrying copper piping, connected to the water boiler/heater system. A pump is connected to drive heater water through the pipes and causes water, heated in a boiler (oil or gas is generally the fuel of choice) to pass through the copper piping. Vertically spaced, thin wall aluminum fins, tightly spaced, have central openings or apertures and pass over the copper piping or, stated differently, the copper piping passes through the aligned apertures of the aluminum fins. When the heating system is "on," a pump causes the coursing of highly heated water through the copper pipes. The copper piping, by conduction, transfers heat to the "in contact" aluminum fins. The aluminum fins, by convection, passes the heat of the water to the air surrounding the fins. Conventionally, the copper piping and the fins are protected by a baseboard heater cover (the cover also ensuring that the heat of the copper pipes cannot easily come into direct contact with one's fingers) which is secured, directly or indirectly, to the adjacent wall and/or the piping. The longitudinal cover is usually snap fit onto one or more spaced (and secured to the wall) bracket elements and, often, has one or more longitudinally extending slats which can be manually flipped opened or closed. The heated air enters the room through the openings between the cover and the slat(s). The angulation of the slats allows the heater air to be directed upwardly and outwardly into the center of the room.

To Applicant's knowledge, the prior art devices suffer from several disadvantages. Specifically, the covers are formed of thin sheet metal, often low grade and thus rustable steel. When the cover comes into contact with water or other liquids, for example in a bathroom with shower water overspray, the covers tend to rust over time. Also, the metallic nature of the aluminum fins, the copper piping and the steel cover, each with their own coefficient of thermal expansion and contraction, causes noise, when heated water is caused to pass through the copper piping. This can be quite annoying. The metallic covers are expensive to make, provide sharp edges for possibly cutting one's fingers upon, are heavy, and unattractive.

The metallic nature of the cover also presents sharp edges which can cause injury to one trying to clean the same by wiping with a cloth.

It is believed highly desirable to provide a simple to install, cover mechanism for a base board heating system which will not rust, is non-metallic, lightweight, simple to clean and does not present sharp, metallic edges or surfaces. A plastic and molded cover of the present invention also allows for aesthetic design at low relative cost. The system provided herein is a clear advance over the prior art in that it is simple to initially install as a new construction or to retrofit by first removing the old cover system from already installed baseboard heater systems in residential homes. It is preferably formed of plastic which will not deform under the expected temperatures, is non-rusting, is moldable, lightweight, will not show dents, can come in colors, and allows for the full circulation of the heated air from the piping and the fins, and does not present sharp edges. The present invention allows, too, for immediate access to the fins and piping, should the same be required, since the cover contemplated herein is a snap-on and snap-off component to a wall-mounted support bracket.

To the Applicant's knowledge, no prior art device utilizes a plastic covering for a baseboard heater to prevent rust, reduce the noise associated with expansion and contraction of the pipes, fins and metallic material, presenting a smooth wall for easy cleaning and without sharp edges.

SUMMARY OF THE INVENTION

The present inventive support bracket and protective cover (allowing heated air to pass therethrough) for a baseboard heater is preferably extruded and formed from a temperature resistant plastic. The support bracket and protective cover are meant to be used with the conventional other components, copper piping and aluminum fins, of a baseboard heating system. The present invention includes a front cover surface and, if desired, a rear cover element to reflect the heat into the room and away from the wall to which the baseboard heating system is attached. The present invention comprises a cover comprises with a set of tio-located vent holes which allow convection-borne heat to flow into the room from the aluminum fins. In the preferred embodiment of the invention, the bracket element secures cover element is secured to a wall by the support bracket elements. The support bracket elements are then attached to the wall by any given method, but preferably by screw anchors. In addition, a set of slat elements, one above the support bracket and one below the support bracket are provided in a preferred embodiment as well. These tend to reflect the heat inwardly, too, i.e., away from the wall to which the copper piping is secured and into the center of the room sought to be heated. The support bracket is configured to accept and retain the upper slat and the lower slat as well, i.e., the slats which are secured to the cover or to the fins. The support brackets, secured to the wall by screws, have one or more outwardly extending arm supports (one below the fins, one above the fins) which accept and are retained within curved sections of the cover element, in a snap-on and snap-off manner. The extending arms, above and below the aluminum fins, tend to protect them from accidental contact with other elements of the system, keeping them spaced apart, which maximizes their utility in radiating heat. In one embodiment of the invention, the lower extending arm of the support bracket provides a pair of opposed ledges or flanges for receipt of a channel member which holds the bottom of the aluminum fins.

The components are preferably made of plastic, and more preferably made of CPVC. The support bracket, with its extending arms and flanges presents a floating "clearance" about the copper pipes and aluminum fins, preventing direct contact therewith, which maintains the efficiency of the system for heating and protects the same during cleaning, by wiping the outside surfaces of the cover and the bottom of the bracket (at the lower extending arm). The floating clearance provided by the support brackets present dimensional clearances to ensure "slip fit" of the components, not a binding fit, at each interface, all to the advantage of the heating system and its maintenance (and reduction of associated noise).

BRIEF DESCRIPTION OF THE DRAWINGS

FIG. 3(*a*) is a front elevational and sectional view of the present invention seen in FIG. 2 and also showing the copper pipe extending therethrough;

FIG. 3(*b*) is a cross-sectional view of the present invention seen in FIG. 2, taken along the lines 3-3 of FIG. 3(*a*);

DETAILED DESCRIPTION OF THE DRAWINGS AND THE PREFERRED EMBODIMENT

Description will now be given of the invention with reference to the attached FIGS. 1-4. It should be understood that these figures are exemplary in nature and in no way serve to limit the scope of the invention, as the invention will be defined by the claims, as interpreted by the Courts in an issued U.S. patent.

Figure 1:
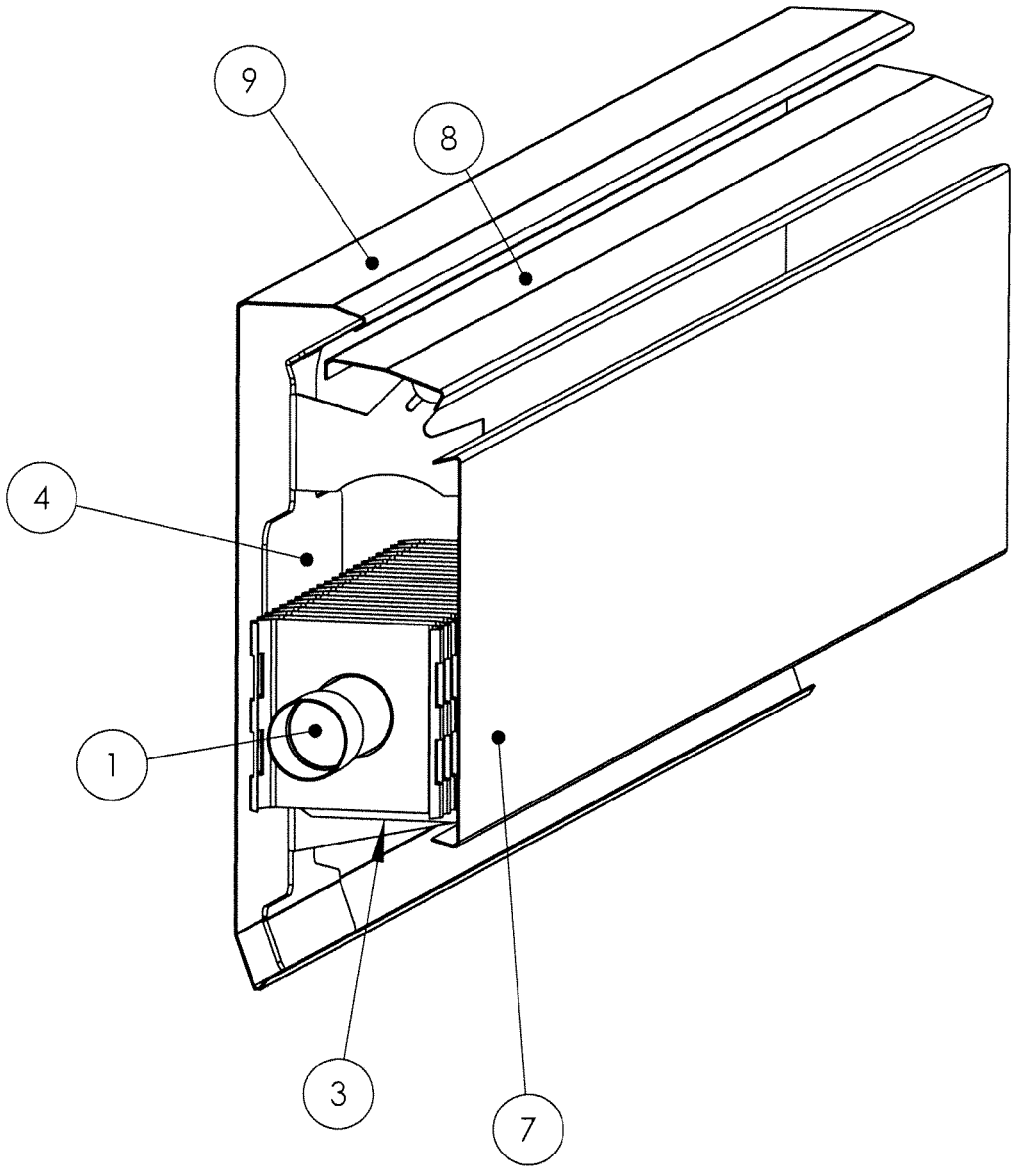
FIG. 1 is a side perspective view of a prior art or conventional and residential baseboard heater assembly, comprising a rear sectional vertical surface for a wall of a room, a bracket secured to it, a rotatable and thus movable horizontal slat for allowing or opening or closing the movement of ambient air from the area of the aluminum fins into the room, and a front conventional metallic cover secured to the bracket. The copper piping and aluminum fins are shown, too.

FIG. 1 is a side perspective view of a conventional, common, residential baseboard heater assembly known in the prior art. Heat exchanger 1 comprises a run of copper tubing passing through thin, spaced, radiating aluminum fins. A metallic bottom support clip 3 distributes the load of the heat exchanger 1 over multiple fins and over separated brackets 4. The rear cover element 9 reflects the heat toward the interior of the room and is adjacent, secured to and rests directly upon the wall of the room; the adjusting vane 8 is rotatable on the bracket and serves to open and close passage of air to the opening and to the fins, while the front cover 7, ordinarily metallic, snaps onto the outstanding ends of the bottom and top section of the brackets.

In operation, heated water from a boiler is adapted to flow through the copper pipes (by a pump pushing the same) into and through the heat exchanger 1 when called for by a typical room thermostat, not shown. By conduction, the hot water heats the copper tubing, which in turn heats the aluminum fins. The aluminum fins (providing substantially large relative surface area) are then able to radiate heat to the air in a room by convection. The adjusting vane 8 can be angled to deflect, even block off, the flow of heated air, or to allow it to flow upwardly and inwardly into the center of the room. The vane can be manually tilted based on a user's preference as to how much heat to circulate in a room. The front cover 7 can be wiped clean, being careful to avoid the sharp outer edges and, indeed, the front cover can be removed and replaced, as desired.

Accordingly to the prior art, front cover 7, bracket 4, rear cover 9 and adjusting vane 8 are manufactured from thin pieces of metal, preferably, lengths of thin-walled steel. Steel is commonly used in baseboard heaters because of its strength, durability, fire resistance, very low thermal expansion, negligible creep, availability, ease of forming into desired shapes, dimensions and configuration, and low cost. The disadvantage of steel is that it requires paint to be rust resistant, and even when painted it is susceptible to rusting from atmospheric humidity, water and other liquids. It also provides sharp edges which can be dangerous and is not as easy to wipe clean with a moistened cloth or rag.

The brackets 4 used in prior art shown in FIG. 1 secure the long steel covers in place. When the steel of the cover 7 expands in moments of providing hot water through the copper piping and in thus changing temperature conditions, the brackets flex and provide a little "give"—necessary to cover the difference in length due to the thermal coefficient of expansion, achieved by the steel when expanded due to the heat. The differences in materials, undergoing rapid changes of temperature when hot water is passed through and stopped from passing through, the copper pipes and aluminum fins, results in noise of "creaking" of the system, which can be disturbing. The design and shape of the prior art baseboard heaters is also considered old, stale and unattractive.

Figure 2:
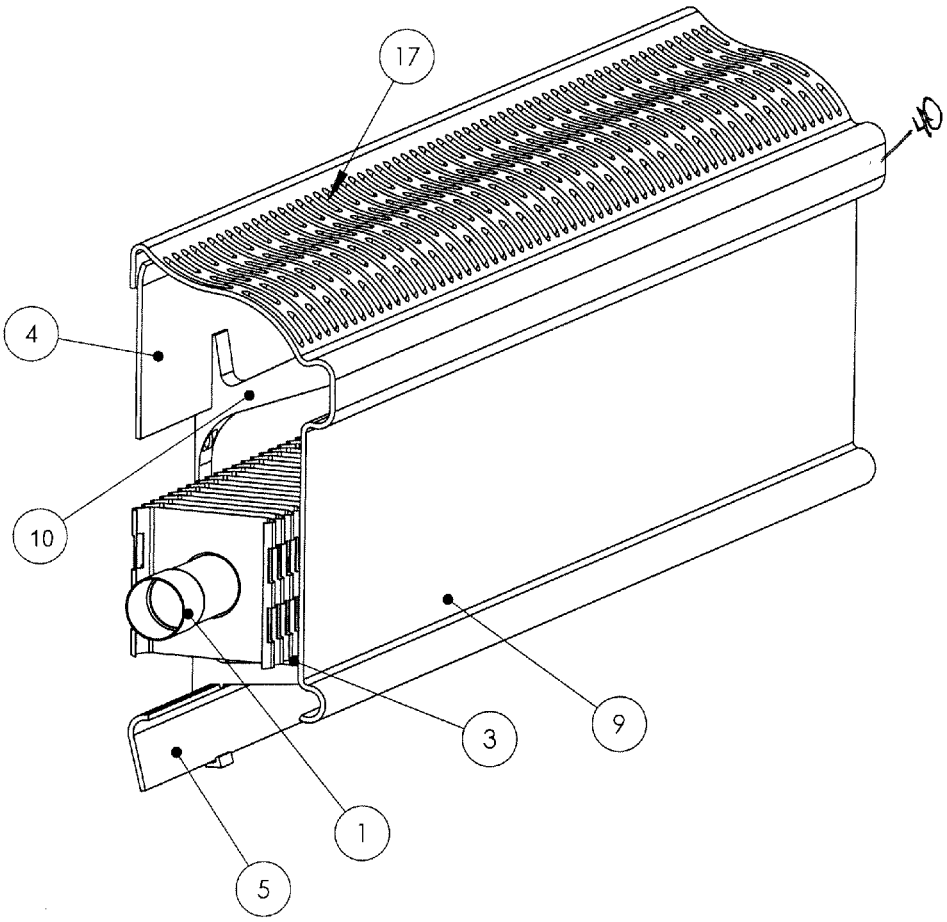
FIG. 2 is a side perspective and cut-away view of a section of the present invention, a new plastic cover with top apertures or openings for allowing passage of air from the fins upwardly and into the room (thus eliminating the rotatable horizontal slat(s)) of the prior art, a support bracket (partially shown) for the cover, a top and a bottom slat (protecting the rear wall of the room and deflecting heat inwardly toward the center of the room), all for a baseboard heater element (copper piping and aluminum fins are conventionally provided and the same as currently available) for residential heat transmission and use. The cover is snapped onto the brackets, with the cover extending slightly around and behind the top slat. The bottom slat is secured into a notched section of the bracket and the bottom of the cover is held over the bottom arm extension's bulbous surface.

FIG. 2 shows a side, cut-away or cross-sectional and perspective view of the present invention, a new cover system for a conventional baseboard heater comprising copper pipe and aluminum fins. Heat exchanger 1 (copper pipes) and the aluminum fins are still used. In addition, if desired, bottom support clip 3 as seen in FIG. 1 may be retained from the prior art, as the current invention presently contemplates new retrofit/replacement applications for at least the cover, support brackets, and further comprising a top and bottom slat secured to the new brackets, all preferably utilizing plastic as an alternative to steel. The present invention is useful and can be adapted as a retrofit application or new installation.

Front cover 9 has a longitudinally running flat and front surface. It also has a longitudinally running top surface (See FIGS. 2, 3(*a*), 3(*b*), and 6(*b*)) provided with a set of closely-spaced air passage apertures. The flat front surface and the aperture-containing top surface are preferably formed from a single continuous, preferably extruded, run of plastic material, and connected by a curved section which fits over and snaps onto the two tines 18 and 19 of the support bracket 10. A rear and top slat 4 (see FIGS. 2 and 6(*d*)) is provided and secured to the wall along with rear and bottom slat 5 (also along the wall) (See FIGS. 2 and 6(*c*)). All are preferably made of extruded plastic, preferably CPVC. These slats will be held against the wall by screws or other fasteners and provide corresponding retention slots at the top of the brackets 10 (see FIG. 3(*b*)) and a bottom extension flange shelf (See FIG. 3(*b*)), respectively. The top slat and bottom slat deflect the heat from the fins inwardly toward the room and up and out of the apertures in the cover. Preferably the top slat has a slight curvature near its top to facilitate the air deflection and securement of the cover to the wall. The bottom slat has a curved upper wall, matching that of the bracket, for deflecting the heat into the room area and facilitating the snap placement of the cover thereover.

The support brackets, preferably secured to the walls of the room by simple screws passing through apertures of the brackets are preferably also made of extruded aluminum. The brackets 10 are best seen in FIGS. 2, 3(*b*) and 5. There one can see a top aperture at the top end of the bracket and another aperture, just below the top extending arm. These apertures accept screws for securing the aluminum brackets to the wall of the room. The top arm, with the planar wall support section, contains a thin slot towards the back into which the top slat is located and supported. The bracket supports the bottom slat towards the back of the bracket as well below the bottom support arm, between a small flange and a notch or bump out, at the end of a curved section connecting the bottom support arm to the back or planar wall support section. The top support arm can have two, spaced, distal tines. These provide resilient top and bottom surfaces for the curved section of the cover (connecting the top of the cover to the flat front wall) to snap over. The distance between the top of the top tine and the bottom of the bottom tine of the support bracket is about that of the curved section 40 (See FIG. 2) to hold the same in place. The resilience of the plastic of the cover and the tines of the bracket allow the cover 9 to be easily yet securely snapped on and removed, as desired.

Connected to front cover 9 and covering the top of the heat exchanger components (copper piping and aluminum fins) is a top cover comprising vent holes 17 which allow convection-borne heat to flow into the room from the aluminum fins.

Front cover 9 and vent holes 17 are the most visible features of the current invention. Rear and top slat 4 is only visible through vent holes 17. Rear bottom slat 5 is only visible from a low sight angle from the floor, at a distance. As can be seen in FIG. 3(*b*) the bottom of the cover 9 has a bump out section 20 which snaps over the protruding front end of the bottom extending arm or a curved hook 21 at the front end of the bottom extending arm of the bracket. Here, too, the resilience of the plastic of the cover and the matching curvature of the hook 21 and the bump out section 20 allow for the cover to be first held onto the support bracket at the bottom, then at the curved section 40 where the section snaps over the protruding tines 18 and 19 of the upper extending arm, and, finally, to secure the same in place, the very top of the cover is turned downwardly to provide a flange 42 which is secured behind the top of the top slat 4. Alternatively, the cover can be placed over the support bracket by first placing the flange 42 behind the top curved section of the top slat and then the curved section 40 over the tines 18 and 19, and then the curved section 20 snaps over the hook 21.

In the preferred embodiment, the bottom extending arm of the bracket provides a pair of opposed support flanges 50 and 51 (See FIGS. 3(*b*) and 5). These support flanges support the aluminum fins and, indeed, a channel 52 (See FIG. 3(*b*)) may also be used to isolate the aluminum fins from the cover and the bracket. Also, as can be seen from the Figures, there is a "float" to the aluminum fins and the copper tubing/piping, which serves to protect them from damage and to isolate them so that they radiate heat into the room.

In the present invention, front cover 9 and rear slats 4 and 5 are manufactured from plastic. Advantages of using plastic as opposed to steel include manufacturing shapes (styles) available to the plastic manufacturing industry, ease of installation, ease of access and cleaning without the danger of cut fingers, deep "through" coloring (beyond a layer of peelable paint), and innate flexibility that both serve to resist visible scratches and dents. Plastic bounces back without bending on impact, and, maybe most importantly, it won't rust when exposed to water. A simple wipe down will keep the visible cover clean without harming the surface.

The floating clearance support bracket 10 is manufactured from extruded aluminum, or some suitably reinforced plastic compound, or steel, as opposed to being made from plastic although it, too, can be made of plastic, if strong enough, or other suitable compositions.

The present invention is designed and comprises materials which cooperate together for the intended function. More specifically, creep resistance, strength, coefficients of thermal expansion, resilience, durability, shapability, etc. are all to be considered. Without the present invention, using cooperative materials which contemplate creep and relative thermal expansion of parts, the overall design would not work to advantage. Thermal expansion is a significant consideration in the design due to the wide fluctuation or change in temperature (with a high thermal expansion material such as CPVC) during normal operation. If a room (and the plastic heater components) cools to 50° F. on a winter night and is then exposed to 180° F. when the heat exchanger is carrying hot boiler water through the copper piping, the 130° F. temperature difference could be expected to expand a 96" long run of the front cover 9 by approximately 0.424". That's a considerable amount of movement with every thermal cycle, and thus the material used must be able to withstand such expansion and contraction, such creep and fatigue, etc. Also, as mentioned, by using plastic material, there will be less creaking/noise when the hot water system activated by the temperature thermostat commences.

FIG. 3(*b*) is a cross-sectional view of the current invention which is taken along line "3-3" of FIG. 3(*a*), a front elevational and partial view of the present invention. Unique features of the present invention which can be seen in FIG. 3(*b*) are mounting screw holes 11, with which floating clearance support bracket 10 is mounted to a wall (not shown) with screws (not shown). Plastic support clip 3 is also shown here; retained as part of heat exchanger 1 from the prior art (See FIG. 1).

To allow free floating along the mounted axis of the long sheet parts (front cover 9, rear top slat 4, and rear bottom slat 5), floating clearance support bracket 10 contains sufficient tolerance or clearances to ensure "slip fit" (not binding) at each interface with the bracket, namely at the flange 42 behind the curved surface of top slat 4; at the bump out 40 with the tines 18 and 19, and at the curved section 20, at the hook member 21. This floating clearance support is not necessary in the steel construction of components used in the prior art. The present invention comprises a material with an extremely small coefficient of thermal expansion.

The top extension arm or upper mounting profile 18 and the bottom extension arm or bump out section 20 engage front cover 9, with a small clearance once cover 9 is snapped into position. The lower tine or support rod recess 19 is available to accommodate a future steel support tube (not shown) if necessary to support front cover 9 against creep. This element of the design is a simple hedge against a potential future problem.

Figure 4:
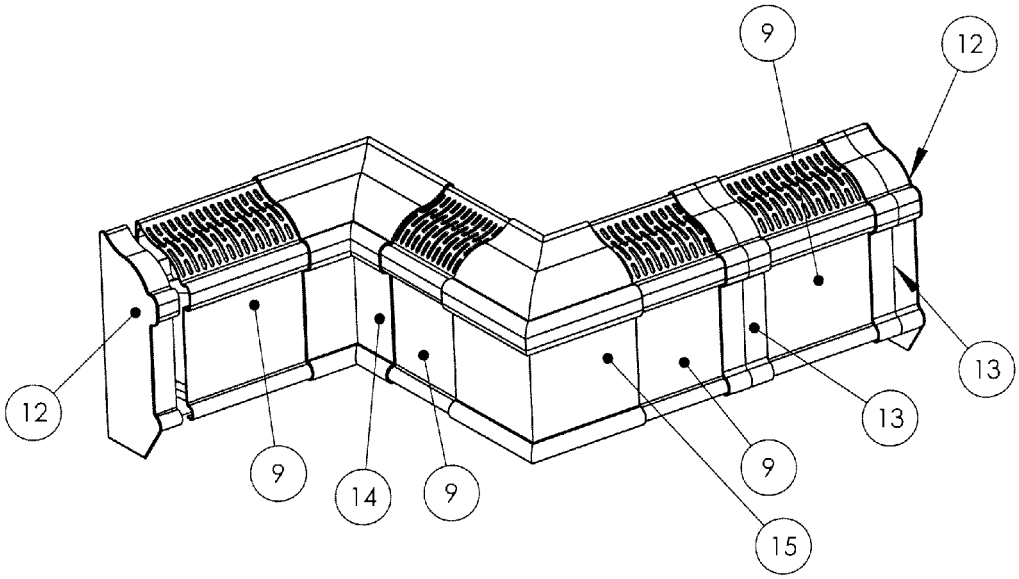
FIG. 4 is a front perspective view of an entire assembly of components of the current invention, showing the baseboard heater as it would be seen along the base of a wall when in use with sections being provided with suitably configured end caps; one or more internal corners, a representative outside corner section, and connecters (for runs of the cover which are longer than conventional (12 feet)) lengths, to provide a visually pleasing and functional baseboard cover system.
Figure 5:
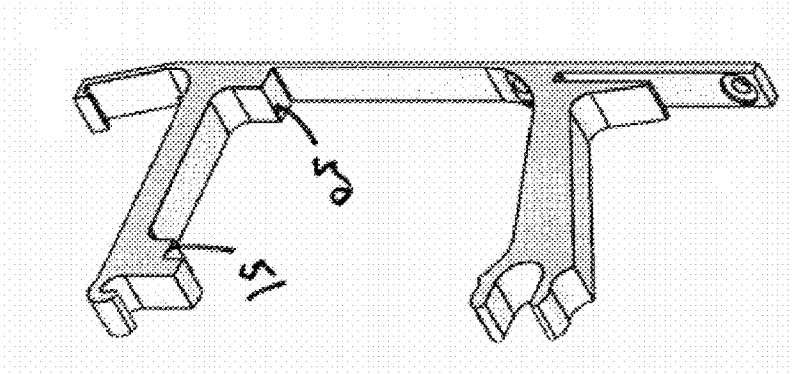
FIG. 5 is a perspective view of the support bracket of the invention.
Figure 6A:
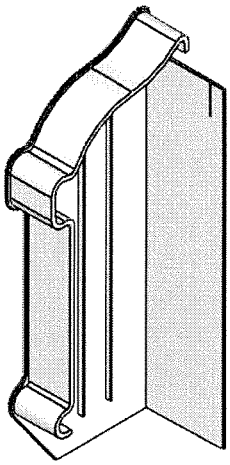
FIG. 6*a* is a perspective view of the inside of an end cap of the invention.
Figure 6B:
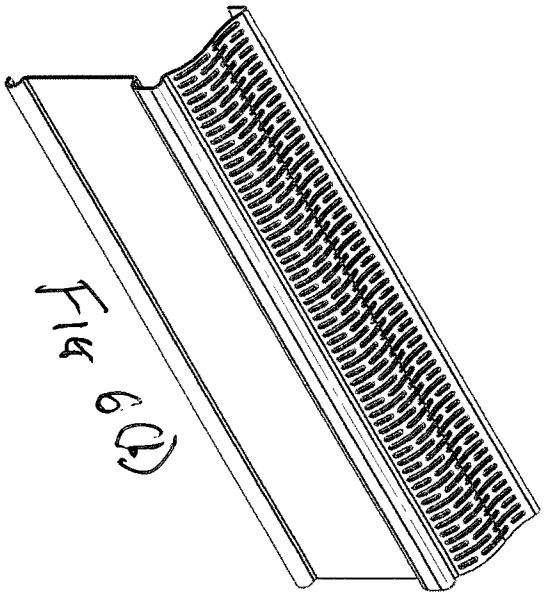
FIG. 6*b* is a perspective view of the front cover with a longitudinally running top surface provided with a set of closely-spaced air passage apertures and a basically flat front panel.
Figure 6C:
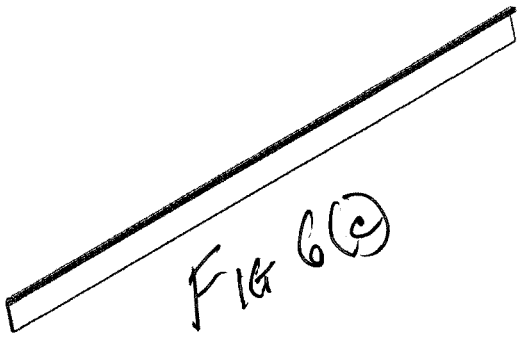
FIG. 6*c* is a perspective view of the bottom slat used in the invention.
Figure 6D:
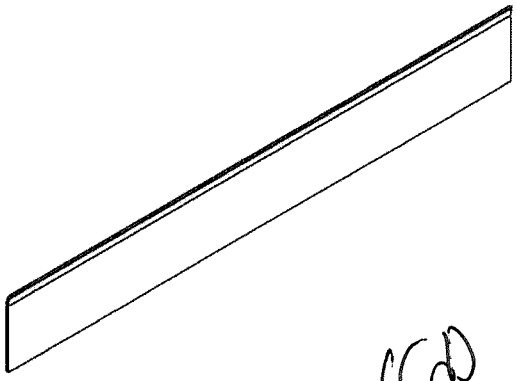
FIG. 6*d* is a perspective view of the top slat used in the invention.
Figure 6E:
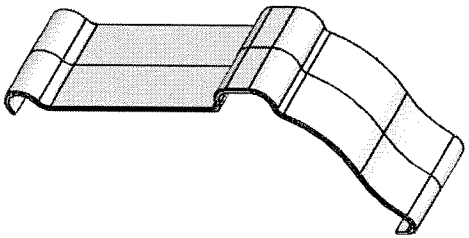
FIG. 6*e* is a perspective view of a pair of snap covers for connecting spares between a long run of the cover, and by extension the invention, so that a long embodiment of the invention appears visually seamless and visually consistent.

FIG. 4 shows the entire assembly of all the visible parts in the current invention when constructed and placed as it would appear against a representative wall when in use, having an inside and an outside corner, for ease of illustration and understanding. The "runs" of the cover are, of course, likely to be longer in length so that the FIG is not drawn to scale. This FIG. however, shows use of an end cap 12 (also shown in FIG. 6(*a*)), snap covers 13 for connecting long runs of the cover so that they appear more visually seamless, front cover sections 9, inside corner 14, and outside corner 15. Note that snap cover 13 acts as a "splice" to join two adjacent front cover 9 parts, as shown.

Note, too, that the invention does not rely upon support of any parts by the end caps 12, which are rigidly attached to the wall at a required spacing from the front cover (marked on the end cap, not shown) so that the expanding front cover 9 (when subjected to increased temperature) will not push into it. Even if the system was installed at a very cold temperature, say, for example, at 0 F, enough expansion is anticipated and designed into the system to allow for temperatures on the plastic of up to 180 degrees F. and the plastic components consequent expansion. This is a new and distinguishing advantage of the present invention over the prior art heaters and covers made of steel.

End cap 12, snap cover 13, corners 14 and 15 are preferably injection molded plastic, and more preferably chlorinated polyvinyl chloride, or CPVC, which is a thermoplastic. Front cover 9 is preferably thermoformed from sheet plastic, preferably 2 mm in thickness, likely CPVC. A secondary operation is necessary to punch the vent holes 17. Front cover 9 may be extruded, too. Floating clearance support bracket 10 is preferably aluminum and made by extruding, or by metal injection molding, or by machining. Alternatively it may be injection molded of a suitable plastic compound, such as glass filled polyamide.

Snap cover 13 is preferably long enough (along the axis of the heater) to conceal the end of front cover 9 in its most contracted (cold) position. The snap cover 13 is also designed to extend entirely by the front cover 9 when it's attached to and supported by end cap 12. Snap cover 13 is preferably in full contact with and fully supported by end cap 12.

Where snap cover 13 is not used at the end of the run of the cover, it can be supported by adjacent front covers 9 as a "splice" component, the fit is preferably very loose to allow front cover 9 to expand and contract thermally.

Inside and outside corners 14 and 15 are supported loosely by front cover 9, which are in turn supported by the support brackets. Corners 14 and 15 are also preferably long enough (along the heater axis) to conceal front covers 9 when they are fully contracted by the change of the water temperature.

A requirement and benefit of the entire system and an element of this design is the ability to retrofit the same onto an existing, prior art, baseboard heater unit. As the heat exchanger 1 and support clips 3 are utilized from the prior art, the present invention should be able to fit not only on new baseboard heaters, but also onto existing heat exchanger systems to replace the prior art steel covers with more attractive, lightweight, rust-resistant covers. In tight spaces or applications where shoe moldings are present, this entails being able to slide covers, end caps, and corners straight "down" from above, without the need for clearance left and right. The current invention meets this criterion.

An existing, prior art steel baseboard heater can be removed, leaving heat exchanger 1 in place (copper pipe and aluminum fins) with procedures known in the art. If a wall is to be papered or painted, this is a good time to install the present invention, after an old unit is first removed. Floating clearance support brackets 10 can be gently manipulated into position behind and under the standing heat exchanger 1 and support clips 3 and screwed to every other or every third wood stud behind the sheetrock with two screws each through the brackets by use of the screw holes 11.

The rear top slat 4 can be laid into the slot of a series of at least two brackets along the wall and centered along the assembly or positioned with sufficient space from any corner 14 or 15, as applicable. An installer spacing gauge (not shown) can be used to establish proper spacing at inside and outside corners.

End caps 12 can be set into place (which may be accomplished sliding down directly from the top) and also anchored to the wall with screws. The rear bottom slat 5 can then be snapped into position at the bottom of the floating clearance support brackets 10. Front cover 9 can be manipulated into position from above and front to loosely slip over curved edge of rear top cover 4, and snapped downwardly and into position at the upper 18 and lower 20 mounting profiles on the floating clearance support brackets 10. Corners 14 and 15 are manipulated into position, if applicable. Snap covers 13 can be snapped into place adjacent the end caps and between adjacent front covers 9, as applicable and if needed. If any of front cover 9, rear top slat 4, or rear bottom slat 5 need to be shortened in the steps above, they can be easily cut with a metal shear. The front cover and its bulges or forward protrusions snap over the outward bulges of the support brackets and thus hold the cover in place.

The floating clearance support bracket 10 that ensures free floating slip fit of all covers and slats, preferably mounts rigidly to a wall, fits behind an existing (prior art) heat exchanger and is the backbone of support for the entire system. The present invention also provides recesses for steel support rods (not shown) in the floating clearance support brackets, if needed against creep. The design of component shapes and thicknesses for low stress are intended to mitigate the effects of creep throughout the entire system. Free floating clearance features and thermal expansion gaps are complete with installation markings in the end caps for proper spacing of the end caps. The installer's use of a corner spacing gauge (not shown) ensures proper spacing at corners. The design of end caps and corners is such that they can be installed from front or top in tight spaces that do not allow end play.

What is claimed is:

1. A cover system for a baseboard heater running longitudinally along the lower portion of a vertical wall in a residential area to be heated having longitudinal extending, water-carrying copper piping, and a set of vertically extending and suspended on the copper piping, horizontally-spaced aluminum fins, the fins having front, back, top and bottom edges, comprising:

two or more support brackets each having a planar back piece attachable to the vertical wall and a top arm extending from said back piece in a direction upwardly and away from said back piece and a bottom arm, below said top arm and beneath the aluminum fins, also extending from said back piece in a direction away from said back piece;

wherein said top arm comprises a distal end comprised of a pair of tines and a base portion connecting said top arm to said planar back piece, a first slot defined between a portion of said base portion and said planar back piece; a first slat of a substantially planar shape;

wherein said bottom arm comprises a distal end having a hook, a base portion of said bottom arm connecting said bottom arm to said planar back piece, a second slot beneath said base portion and holding a second slat;

a plastic cover piece comprising a flat front portion parallel to said first and second slats, said cover piece having a top surface extending from said distal end of said top arm to the top of said back piece, said cover piece further comprising a snap-fit bulge area corresponding to the ends of said pair of tines, said snap-fit bulge area disposed at a central portion of said cover piece and configured to connect to the ends of said pair of tines at said central portion, said bulge area connecting said top surface to said flat front portion;

and a second snap-fit bulge area, located at the bottom of said flat front portion and corresponding to said hook and snappable onto said hook such that said flat front portion is snapped to and around each tine of said pair of tines and said hook to form a gap between said flat front portion and the front edges of said fins and such that said top surface extends parallel to and above said first and second slats.

2. The system as in claim 1 further including interior and/or exterior corner covers connectors that join said plastic cover piece and one or more adjacent plastic cover pieces.

3. The system as in claim 1 that further includes one or more snap connector seams joining sections that join said plastic cover piece and one or more adjacent plastic cover pieces.

4. The system as in claim 1 wherein said distal end of said top arm includes two flanges such that the space between said flanges is able to accommodate a steel support tube.

5. The system as in claim 1 wherein said bottom arm further includes a pair of opposed support flanges that are able to support and protect the aluminum fins.

6. The system as in claim 1 wherein said second slat has a curved upper wall and wherein a support bracket of said two or more support brackets is shaped to accommodate said curved upper wall of said second slat.

7. The system as in claim 1 further comprising an end cap which covers the said two or more support brackets, said first and second slats and said plastic cover piece.

8. The system as in claim 1 wherein said support brackets further includes apertures for accepting screws for wall mounting.

9. The system as in claim 1 wherein said first slat includes a top curvature.

10. The system as in claim 1 wherein said bottom arm further includes a bottom support clip.

11. The system as in claim 1 wherein the plastic cover piece is made of CPVC plastic.

12. The system as in claim 1 wherein the plastic cover piece is one continuous piece of plastic.

* * * * *